US011454242B2

(12) United States Patent
Udagawa

(10) Patent No.: US 11,454,242 B2
(45) Date of Patent: Sep. 27, 2022

(54) AIR BLOWING DEVICE AND AIR BLOWING MACHINE FOR GENERATING RISING AIR

(71) Applicant: FUNABORI Co., Ltd., Tokyo (JP)

(72) Inventor: Masanori Udagawa, Tokyo (JP)

(73) Assignee: FUNABORI CO., LTD., Tokyo (JP)

( * ) Notice: Subject to any disclaimer, the term of this patent is extended or adjusted under 35 U.S.C. 154(b) by 0 days.

(21) Appl. No.: 16/968,873

(22) PCT Filed: Oct. 15, 2018

(86) PCT No.: PCT/JP2018/038310

§ 371 (c)(1),
(2) Date: Aug. 11, 2020

(87) PCT Pub. No.: WO2019/171646

PCT Pub. Date: Sep. 12, 2019

(65) Prior Publication Data

US 2021/0007449 A1 Jan. 14, 2021

(30) Foreign Application Priority Data

Mar. 5, 2018 (JP) ..... JP2018-038416
Jul. 5, 2018 (JP) ..... JP2018-128026
Sep. 11, 2018 (JP) ..... JP2018-169504

(51) Int. Cl.
*A45B 23/00* (2006.01)
*F04D 19/00* (2006.01)
(Continued)

(52) U.S. Cl.
CPC ..... *F04D 19/002* (2013.01); *A45B 23/00* (2013.01); *A47B 37/04* (2013.01); *A45B 2023/0012* (2013.01); *A45B 2025/003* (2013.01); *A45B 2200/1036* (2013.01); *A45B 2200/1063* (2013.01)

(58) Field of Classification Search
CPC ..... A45B 2200/1036
See application file for complete search history.

(56) References Cited

U.S. PATENT DOCUMENTS 1,148,332 A * 7/1915 Onyskow ..... A45B 3/00 135/16
3,177,881 A * 4/1965 Covington ..... A45B 3/00 135/16

(Continued)

FOREIGN PATENT DOCUMENTS

JP S584796 U 1/1983
JP S6238495 U 3/1987

(Continued)

*Primary Examiner* — Noah Chandler Hawk
(74) *Attorney, Agent, or Firm* — Hauptman Ham, LLP

(57) ABSTRACT

An air blowing device includes: an air blower provided in connection with a support stand, the air blower being configured to generate rising air; a support frame attached to the support stand; and a wind-direction changing device configured to change a wind direction to a direction crossing a direction of the rising air upon receipt of the rising air, wherein descending air blown to periphery around the air blower is generated by the wind-direction changing device, and the wind-direction changing device is supported by the support frame.

8 Claims, 7 Drawing Sheets

(51) Int. Cl.
*A47B 37/04* (2006.01)
*A45B 25/00* (2006.01)

(56) References Cited

U.S. PATENT DOCUMENTS 3,228,317 A * 1/1966 Westman ..... A47C 7/74 454/338
3,444,799 A 5/1969 Covington
4,623,367 A * 11/1986 Paulson ..... B01D 46/10 454/67
5,007,811 A * 4/1991 Hopkins ..... A45B 3/00 135/16
5,078,574 A * 1/1992 Olsen ..... F04D 19/002 415/182.1
5,172,711 A * 12/1992 Mueller ..... A45B 3/00 135/16
5,273,062 A * 12/1993 Mozdzanowski ..... A45B 3/00 135/16
6,230,723 B1 * 5/2001 Hixson ..... A45B 3/00 135/16
6,298,866 B1 * 10/2001 Molnar, IV ..... A45B 3/00 108/50.12
6,852,025 B2 * 2/2005 Gumucio Del Pozo . A45B 3/00 416/171
7,537,015 B1 * 5/2009 Molnar, IV ..... A45B 23/00 108/50.12
2004/0213687 A1 10/2004 Cheng
2004/0221882 A1 11/2004 Watson et al.
2009/0090403 A1 * 4/2009 McCalla ..... F24F 7/007 135/16

FOREIGN PATENT DOCUMENTS

JP H9289912 A 11/1997
JP H1054393 A 2/1998
JP 2002221185 A 8/2002
JP 20122233 A 1/2012
JP 2013127216 A 6/2013
JP 201431742 A 2/2014
WO 2011081175 A2 7/2011

* cited by examiner

AIR BLOWING DEVICE AND AIR BLOWING MACHINE FOR GENERATING RISING AIR

CROSS REFERENCE TO RELATED APPLICATION

This is a U.S. national stage of application No. PCT/JP2018/038310, filed on Oct. 15, 2018. Priority under 35 U.S.C. § 119(a) and 35 U.S.C. § 365(b) is claimed from Japanese Patent Applications No. 2018-038416 filed on Mar. 5, 2018; No. 2018-128026 filed on Jul. 5, 2018; and No. 2018-169504 filed on Sep. 11, 2018.

TECHNICAL FIELD

The present invention relates to an air blowing device and an air blowing machine for generating rising air, by which air can be blown to workers working at workbenches or users of an eating/drinking table or the like, from above.

BACKGROUND ART

Some rest stations or the like have spaces where tables are installed to allow users to eat and drink, have conversation, or do other things. For example, in a rest station of a theme park, in an open space in front of an entrance of a convenience store, in an outdoor space of a fast food restaurant, on a terrace of a coffee shop, in the neighborhood of a vending machine of refreshments, or the like, tables are installed to allow users to enjoy conversation while eating and drinking, in some cases. In those places such as a rest station, some of tables installed outdoors are each provided with a large umbrella like a beach umbrella to block sunshine in summer. Alternatively, there is provided a large tent that covers a plurality of tables.

However, in a case where strong sunlight is reflected from the ground or an outside air temperature is high, users of a rest station are exposed to a high temperature and cannot avoid the heat satisfactorily though being protected from sunshine. One possible solution to this is to install a fan for outdoor use in a rest station and blow air. Another possible solution is to provide a fan at each table, such as a fan that is supported on an end of the table by a clip, for example (refer to PTL 1).

As a fan for outdoor use, a fan mainly used in a factory or the like is commercially available. The examples thereof include a stand-up fan in which an air blowing unit is mounted on an upper portion of a support rod provided so as to move upward and downward in a stand such as a tripod, a large fan in which an air blowing unit is provided inside an inclined rectangular frame, and the like. However, in a case where those fans are installed in a rest station, due to large wind pressure of those fans, a wind provided therefrom is too strong for users to feel relaxed. Regarding a fan of a type supported on a table by a clip, due to the small size thereof, it is difficult to furnish the fan with a swing mechanism. This makes it difficult to blow air to all persons around the table. Further, regarding a portable fan (refer to PTL 2), its main purpose is to blow air to a person carrying the portable fan and the portable fan cannot blow air to all persons around the table.

Meanwhile, PTL 3 and PTL 4 disclose a fan that is formed so as to be capable of blowing air in a wide range.

Further, PTL 5 discloses a movable air blowing apparatus including an air blower that can move along a guide provided on a wall or the like of a house.

Further, PTL 6 discloses a ceiling fan that is provided on a ceiling and blows air from above by rotation of blades.

Further, PTL 7 discloses a fan with a lighting fixture in which a single motor driven by an alternating current or a direct current is provided in a single column-shaped member and a fan that blows air upward or downward depending on a rotation direction of the motor to stir the air upward and downward is connected. PTL 7 discloses a configuration in which a platform extends to a body of the column-shaped member and a cover supported by a strut is provided above the fan.

Further, PTL 8 discloses a golf umbrella in which an air blowing unit that makes and sends a wind to a target place is mounted on a shaft of the golf umbrella.

Further, PTL 9 discloses an umbrella with a fan including a battery box that a user can carry on his back, a flexible arm extending upward from the battery box, a fan mounted on an upper end of the arm, and an umbrella body mounted so as to cover the fan.

CITATION LIST

Patent Literature

{PTL 1} JP 2002-221185 A
{PTL 2} JP 1998-054393 A
{PTL 3} JP 2013-127216 A
{PTL 4} JP 2004-324640 A
{PTL 5} JP 2014-031742 A
{PTL 6} JP 2012-002233 A
{PTL 7} JP S58-4796 U
{PTL 8} JP H9-289912 A
{PTL 9} JP S62-38495 U

SUMMARY OF INVENTION

Technical Problem

The fans disclosed in PTL 1 and PTL 2 are unsuitable for air blow in a wide range, and thus are unsuitable for blowing air such that a wind reaches every user of a rest station or the like.

Further, the fan disclosed in PTL 3 is capable of changing a direction of air blow through 360 degrees horizontally, and is designed to blow air horizontally. Further, the fan disclosed in PTL 4, which has a pair of fans that are connected to each other on their back surfaces and blow air in opposite directions, is capable of blowing air in a wide range. However, this fan blows air horizontally. Those fans are intended for indoor use. Moreover, in a case where a fan blows air horizontally, like the above-described types of fans, when it is required to blow air at an appropriate wind pressure in a place such as a rest station where a plurality of tables and the like are installed, a wind does not reach a place remote from the fan and no air is blown to some tables and the like. Further, in a case where there is an obstruction in an air-blown area, a wind may probably be blocked by the obstruction and fail to reach some places. Additionally, installing a plurality of fans allows air to be blown to every place. However, this is not desirable because such fans may interfere with a user's walking or the like depending on installation locations of the fans.

Further, the movable air blowing apparatus disclosed in PTL 5 requires a guide for guiding movement of an air blower. This limits installation of the apparatus to indoor installation in which the guide can be attached to a wall or the like. Thus, the apparatus is unsuitable for outdoor installation.

Moreover, the ceiling fan disclosed in PTL 6, which can blow air to a user from above, is mainly intended to promote indoor air circulation and is not intended to blow air to a user of an outdoor rest station or the like.

In the fan with a lighting fixture disclosed in PTL 7, because a fan unit is provided on an upper end of the upright column-shaped member, the upright column-shaped member interferes with conversation of people surrounding the upright column-shaped member. Further, the platform extending from the upright column-shaped member does not have a size enough for people surrounding it to eat and drink and the like thereon. Moreover, the upright column-shaped member also interferes with users.

In view of those matters, it is an object of the present invention to provide an air blowing device that can surely blow air to users who enjoy eating/drinking and conversation or take a rest using a table or the like installed outdoors, to allow the users to spend time comfortably, and an air blowing machine for generating rising air suitable for use in the air blowing device.

Solution to Problem

To overcome the above-described problems, an air blowing device according to the present invention includes: an air blower provided in connection with a support stand, the air blower being configured to generate rising air; a support frame attached to the support stand; and a wind-direction changing device configured to change a wind direction to a direction crossing a direction of the rising air upon receipt of the rising air, wherein descending air blown to periphery around the air blower is generated by the wind-direction changing device, and the wind-direction changing device is supported by the support frame.

When rising air generated from the air blower collides against the wind-direction changing device, a wind direction is changed. After the change, air is blown in a direction crossing the direction of the rising air. When the direction is changed by the wind-direction changing device so that a wind bends, descending air is generated. The descending air is sent to periphery around the air blower, and thus the descending air is blown to users present in a position surrounding the air blower. Therefore, the users, who receive the wind, can feel cooler in summer.

The support stand includes a workbench for manual work or other work and a table for eating and drinking or the like.

The air blower is provided in connection with the support stand. For example, a through hole through which a body of the air blower is inserted is formed in the support stand and the air blower is inserted through the through hole to be held, thereby connecting the air blower and the support stand. In a case where the air blower is mounted on the support stand, the support frame attached to the support stand so as to surround the air blower restricts movement of the air blower, thereby connecting the support stand and the air blower.

In this manner, providing the air blower in connection with the support stand prevents the air blower from moving due to vibration or the like.

Alternatively, an air blowing device according to the present invention includes: an air blower configured to generate rising air; an air filter provided on a suction opening or a discharge opening of the air blower; and a wind-direction changing device configured to change a wind direction to a direction crossing a direction of the rising air upon receipt of the rising air, wherein descending air blown to periphery around the air blower is generated by the wind-direction changing device.

Further, the air blowing device according to the present invention includes the air filter to prevent air blown from the air blower from containing dust or the like. In particular, in a case where the air filter is capable of removing PM 2.5, particulate matters can be removed, which enhances comfort of a user who receives air blow from the air blowing device.

Further, as the suction opening of the air blower is placed in a position near the ground, dust or the like flying up from the ground may probably be taken in. Then, the air filter captures such dust, thereby removing dust from air to be blown.

Further, in the above-described air blowing device according to the invention, it is preferable that the air blower including the air filter is provided in connection with a support stand, a support frame is attached to the support stand, and the wind-direction changing device is supported by the support frame.

Further, in the above-described air blowing device according to the invention, the support stand can be a table usable for eating and drinking.

Specifically, using the support stand as a table for eating and drinking offers convenience in taking refreshments purchased at a convenience store, a coffees shop, a fast food restaurant, a vending machine, or the like, on the spot. This makes the air blowing device according to the present invention suitable to be installed in a rest station or the like.

Further, in the above-described air blowing device according to the invention, the wind-direction changing device includes an umbrella unit that is formed to have a shape of a circular or polygonal umbrella in plan view, and air blown from the air blower is caused to rise along a center line of the umbrella unit and collide against an inner surface of the umbrella unit.

Rising air generated from the discharge opening of the air blower flows vertically in a form of a column.

Then, the umbrella unit of the wind-direction changing device is formed to have a shape of a circular or polygonal umbrella in plan view, and the rising air is caused to rise along a center line of the umbrella unit, in other words, along a shaft supporting the umbrella unit. The rising air is changed its direction along an inner surface of the umbrella unit, so that descending air flowing downward is generated from periphery of the umbrella unit. Thus, a user present below the wind-direction changing device faces a wind. Additionally, the descending air, which is generated by a change in a direction along the inner surface of the umbrella unit, is blown over a 360-degree range around a circle having its center on the center line of the wind-direction changing device.

Further, the support frame attached to the support stand is formed such that it can support the shaft of the umbrella unit.

Further, in the above-described air blowing device according to the invention, it is preferable that the wind-direction changing device has interchangeability so as to be replaced with devices in various forms by request.

It is preferable that various types of devices different in size, shape, height, or the like, for example, are prepared and a device with a desired size or the like is chosen as the wind-direction changing device to allow a destination of descending air to be changed depending on a size or shape of the support stand.

Further, in the above-described air blowing device according to the invention, it is preferable that the air blower is capable of blowing warm air.

That is, causing the air blower to blow warm air allows users to eat and drink, have conversation, do desired work, or do other things while keeping them warm in winter.

Further, in the above-described air blowing device according to the invention, it is preferable that a plurality of shield plates are provided on a discharge opening of the air blower to allow a part of the discharge opening to be opened and closed by the shield plates so that air blow in a desired direction is blocked.

For example, in a case where there is a person who does not like to face a wind among users, it is possible to prevent the person from facing a wind by closing a part of the discharge opening with the shield plates.

Alternatively, to overcome the above-described problems, an air blowing device according to the present invention includes: an air blower configured to generate rising air; and a wind-direction changing device configured to change a wind direction to a direction crossing a direction of the rising air upon receipt of the rising air, wherein descending air blown to periphery around the air blower is generated by the wind-direction changing device, the air blower is placed in a tent, and a roof of the tent is used as the wind-direction changing device.

In a case where the wind-direction changing device is formed of the above-described umbrella unit, air blown from the air blower goes within such a narrow range as an area around the support stand. Thus, this is preferable in a case of doing work on the support stand. However, if a worker moves about in a wide range, the umbrella unit having a shape of an umbrella does not allow air to be blown over a wide range, to probably cause inconvenience. To overcome such inconvenience, the air blower is placed in a tent and a roof of the tent is used as the wind-direction changing device.

Thus, a user can move about in the tent, and further, placing a plurality of support stands and a plurality of air blowers in the tent can cope with an increase of the number of users.

Additionally, the term "tent" in this specification means a structure such as a sunshade tent, for example, in which a roof formed of a roof-shaped sheet is supported by the appropriate number of struts.

Alternatively, to overcome the above-described problems, an air blowing device includes: an air blower configured to generate rising air; and a wind-direction changing device configured to change a wind direction to a direction crossing a direction of the rising air upon receipt of the rising air, wherein an air filter is provided on a suction opening or a discharge opening of the air blower, descending air blown to periphery around the air blower is generated by the wind-direction changing device, the air blower is placed in a tent, and a roof of the tent is used as the wind-direction changing device.

That is, it is intended to blow clean air as descending air in the tent through the air filter.

Further, it is preferable that the air blower placed in the tent is provided in connection with a support stand.

Further, it is preferable that the support stand connected with the air blower placed in the tent is a table usable for eating and drinking.

Further, in the air blowing device according to the present invention, the air blower placed in the tent is capable of blowing warm air.

To overcome the above-described problems, an air blowing machine for generating rising air according to the present invention is an air blowing machine for generating rising air used in the air blowing device, and support is provided by a support stand with a discharge opening being directed upward.

Further, it is preferable that the air blowing machine for generating rising air is capable of blowing warm air.

Further, it is preferable that the support stand of the air blowing machine for generating rising air is a table usable for eating and drinking.

Advantageous Effects of Invention

The air blowing device according to the present invention blows air to a user present in the neighborhood of an air blower from above. Thus, no obstruction exists in an air-blown area and air is surely blown to the user.

Further, a user can do work or take a rest comfortably using the support stand on which the air blower is mounted. Moreover, unlike a fan that blows air horizontally, the air blowing device blows air from above, which minimizes a risk that parts, documents, or the like necessary for work on the support stand are accidentally blown away by wind.

In a case where a roof of a tent is used as the wind-direction changing device, a worker can receive air blow from above even while moving in the tent so that comfortability during working is maintained even in a case of work involving movement.

Further, the air blower is allowed to be used as an air blowing device in a state of being placed, for example, on the ground while the air blower is held in an appropriate frame assembled from pipes, shaped steel or the like. And, stable air blow is performed while the air blower is provided in connection with the support stand.

Further, in a case where warm air is blown from the air blower, a user can take a rest or do work in a warm atmosphere and can spend time comfortably also in winter.

Further, installing the air blowing device according to the present invention in an outdoor rest station of a theme park or the like or in the neighborhood of a convenience store, a fast food restaurant, a coffee shop, a vending machine, or the like allows users to spend time comfortably while enjoying eating and drinking or conversation outdoors.

DESCRIPTION OF EMBODIMENTS

Figure 1:
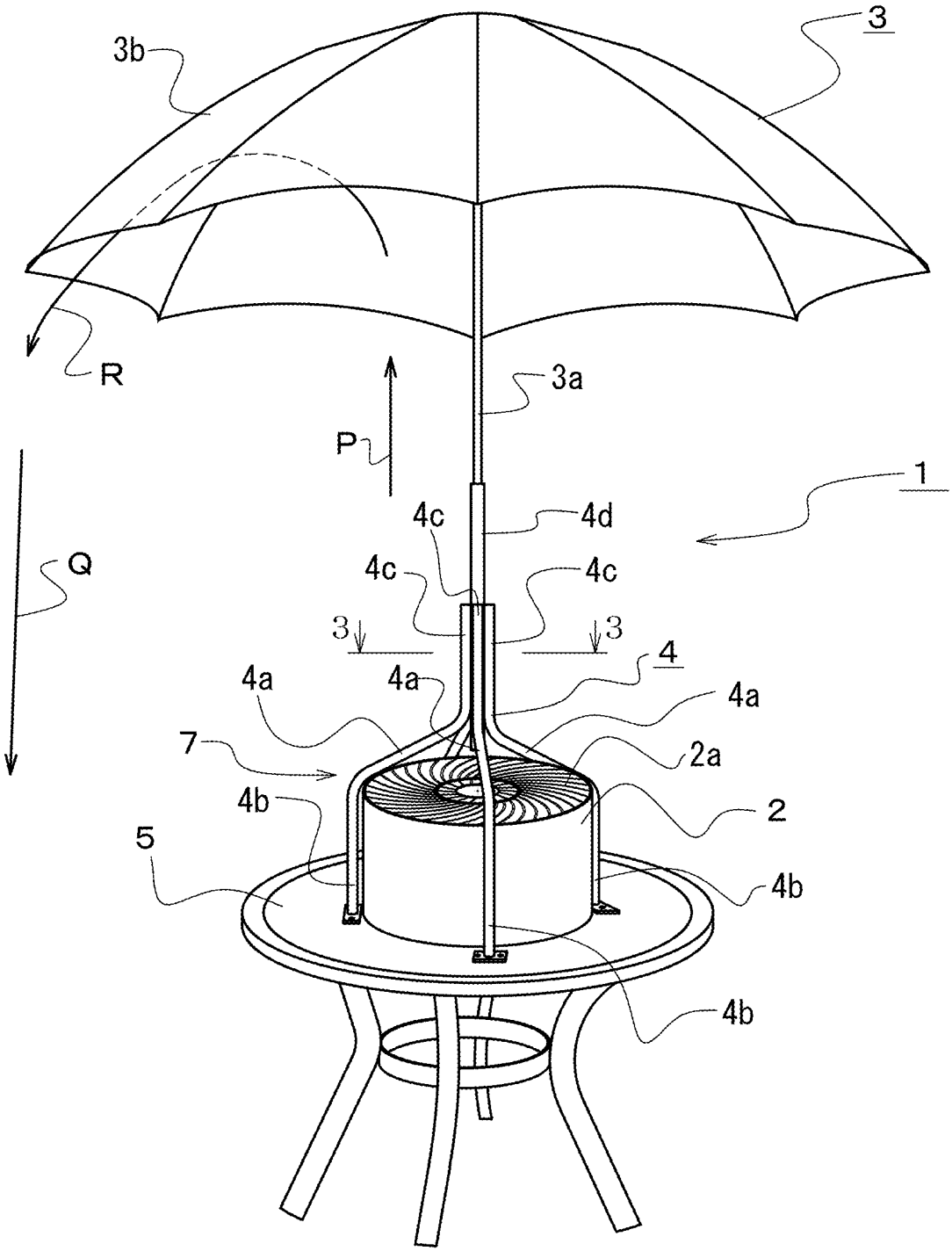
FIG. 1 is a schematic perspective view for explaining a first embodiment of an air blowing device and an air blowing machine for generating rising air according to the present invention.

Hereinafter, an air blowing device and an air blowing machine for generating rising air according to the present invention will be specifically described based on preferred embodiments illustrated in the drawings.

Figure 2:
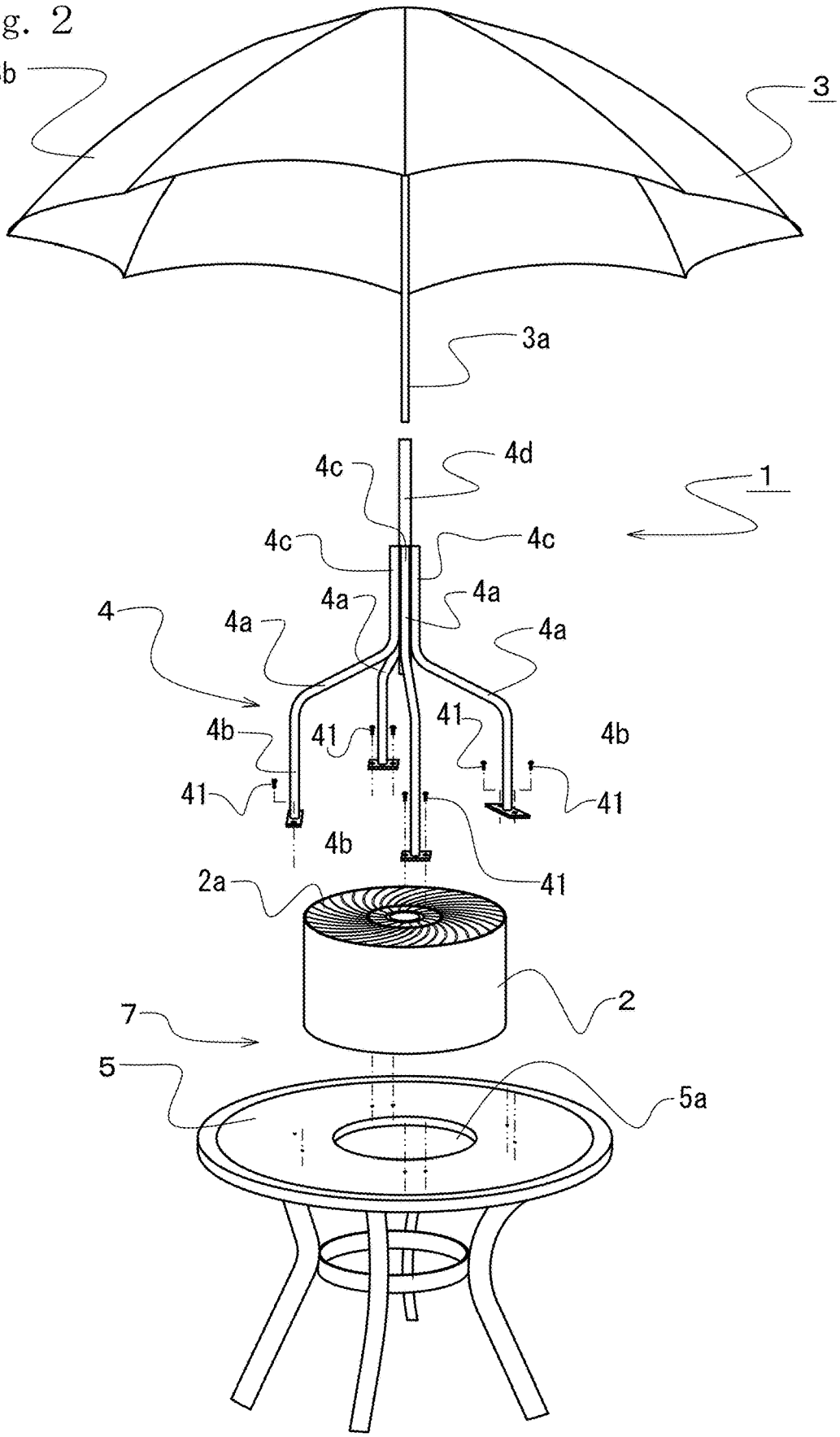
FIG. 2 is an exploded perspective view of the air blowing device illustrated in FIG. 1.
Figure 3:
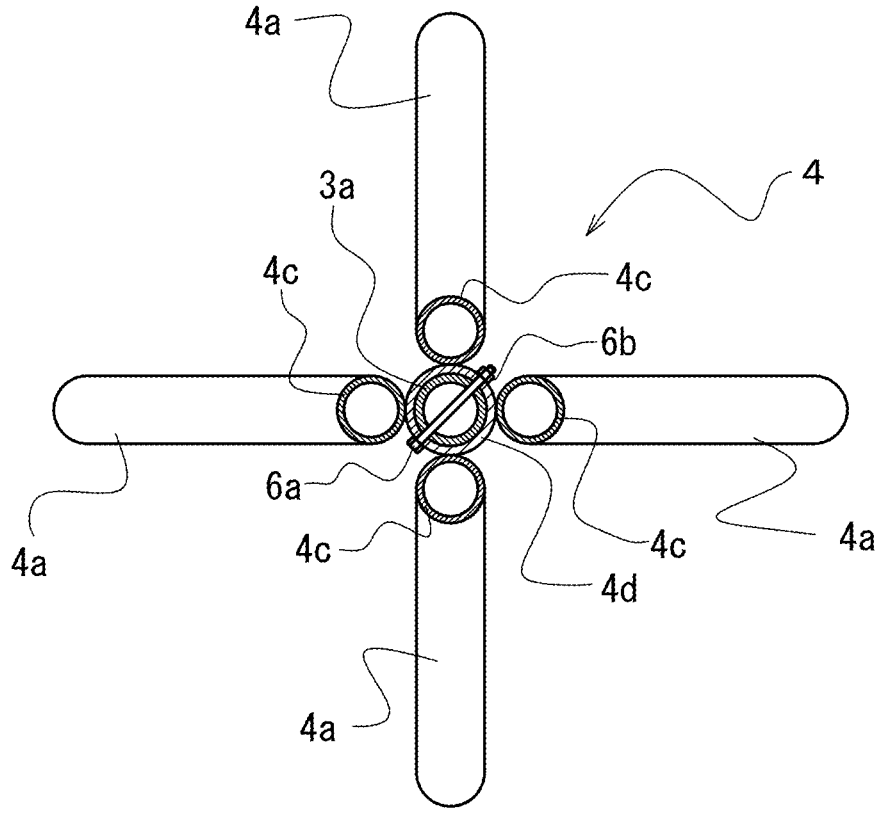
FIG. 3 is a sectional view taken along a line 3-3 in FIG. 1.

FIGS. 1 to 3 illustrate a first embodiment of the air blowing device and the air blowing machine for generating rising air according to the present invention. An air blowing device 1 mainly includes an air blower 2, an air guide umbrella 3 serving as a wind-direction changing device, and a support frame 4 that supports the air guide umbrella 3. Though this embodiment illustrates a state in which the air blower 2 is mounted on a circular table 5 that is a support stand, a workbench for manual work, a writing desk on which papers or the like can be spread, or the like can be used as a support stand. Further, a shape of a top plate of a support stand is not limited to a circular shape. Then, the air blower 2 and the table 5 that is a support stand form a rising-air generating air-blowing machine 7.

The air blower 2 is provided with a discharge opening 2*a* which is directed upward so that rising air to be blown upward is generated. The discharge opening 2*a* may be covered with a cover of a porous plate formed with many through holes or a cover of a net so that air discharged therefrom can be sent through such a cover as mentioned above (not illustrated). As the discharge opening 2*a* is directed upward, it is preferable to provide the discharge opening 2*a* with an appropriate cover because the cover can prevent foreign matters or the like from entering from the discharge opening.

Further, a suction opening of the air blower 2 is provided on an opposite side of the discharge opening 2*a* and an opening 5*a* is formed at an approximate center of the table 5 as illustrated in FIG. 2. While the air blower 2 is in a state of being mounted on the table 5, the suction opening of the air blower 2 is positioned in alignment with the opening 5*a* and air is taken in through the opening 5*a*.

Respective legs 4*b* of four rods 4*a* of the support frame 4 are arranged in a state of surrounding the air blower 2. In the support frame 4, lower ends of the legs 4*b* are fixed to the table 5 with fixing screws 41 as illustrated in FIG. 2. Thus, the air blower 2 is confined by the legs 4*b* and is restrained from moving from a mounting position.

The support frame 4 includes the four rods 4*a* each being bent in a crank form. The legs 4*b* are formed in one ends and support portions 4*c* are formed in the other ends. As illustrated in FIG. 3, those support portions 4*c* are provided close to each other and a support rod portion 4*d* having a cylindrical section is arranged in a center of the support portions 4*c*. Then, each of the support portions 4*c* is fixed to the support rod portion 4*d* by welding or the like.

Figure 4:
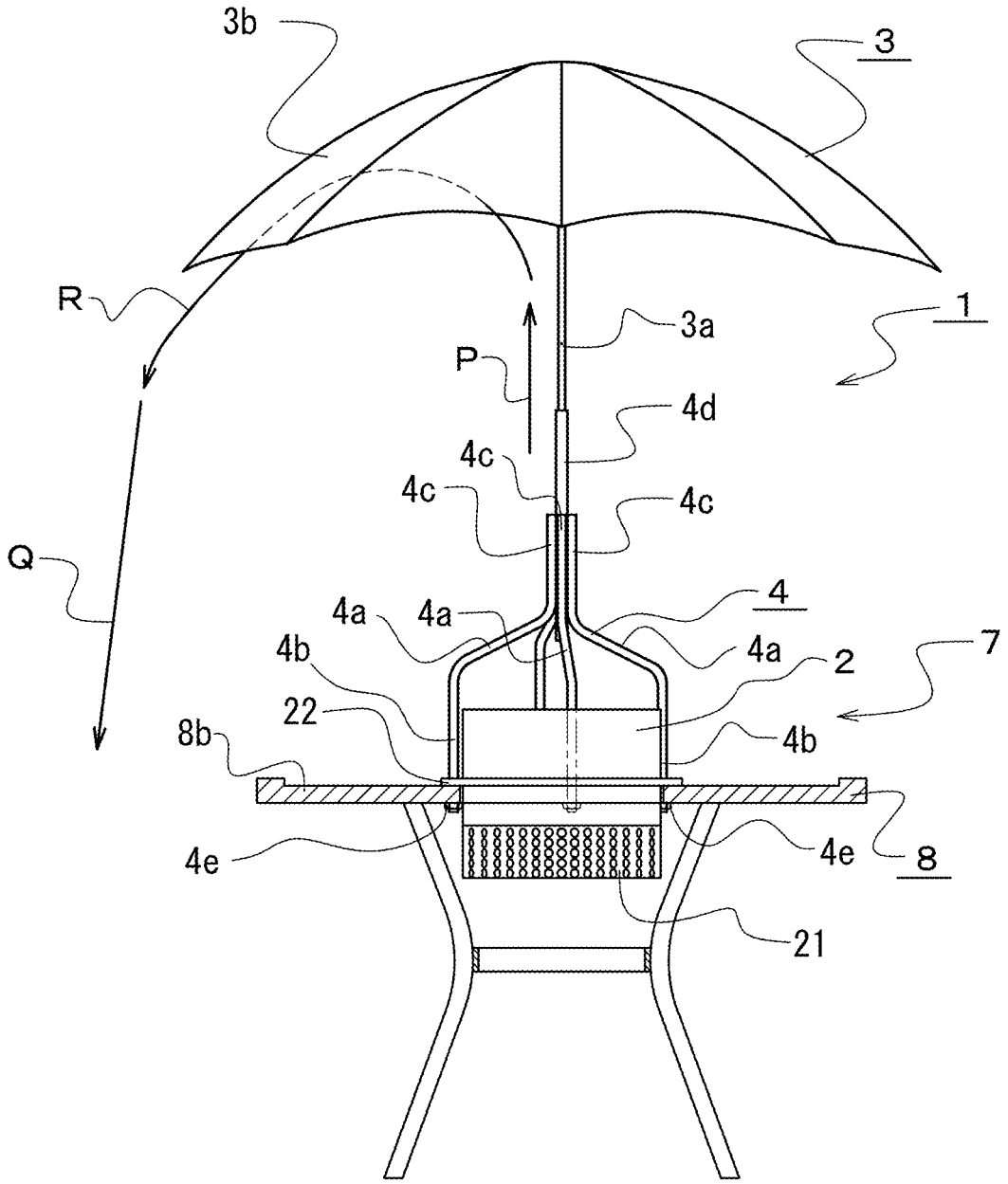
FIG. 4 is a front view for explaining a second embodiment of the air blowing device and the air blowing machine for generating rising air according to the present invention, and illustrates a section of a part of a table corresponding to a support stand.

The air guide umbrella 3 has a configuration in which an umbrella unit 3*b* having a shape of a circular or polygonal umbrella in plan view is supported on one end of a shaft 3*a*. The other end of the shaft 3*a* of the air guide umbrella 3 is removably inserted into the support rod portion 4*d* and the height of the umbrella unit 3*b* is to be changed depending on the insertion position of the shaft 3*a*. Further, the shaft 3*a* may have a telescopic configuration such that the length of the shaft 3*a* may be adjusted. This allows the length of the shaft 3*a* to be changed. Moreover, it is preferable that various kinds of air guide umbrellas 3 have interchangeability by supporting various kinds of air guide umbrellas 3 that are different in shape, outer diameter, or the like of the umbrella unit 3*b* on the support rod portion 4*d*. Additionally, a fixing means that fixes a tip end of the shaft 3*a* to the support rod portion 4*d* is provided. For example, as illustrated in FIG. 4, there can be provided a structure in which through holes are formed in respective appropriate positions of the support rod portion 4*d* and the shaft 3*a*, a fixing bolt 6*a* is inserted through the through holes being aligned with each other, and a fixing nut 6*b* is fastened to a screw portion of the fixing bolt 6*a*. Using this structure or other structures can fix the shaft 3*a* of the air guide umbrella 3 to the support rod portion 4*d*.

Operations of the air blowing device 1 according to the present invention having the above-described configuration will be described below.

As illustrated in FIG. 2, the air blower 2 is mounted on the table 5 such that the suction opening of the air blower 2 faces the opening 5*a*, the four legs 4*b* are provided in a state of surrounding the air blower 2, and the tip ends of the legs 4*b* are fixed to the table 5 with the fixing screws 41. As a result of this, the air blower 2 is placed in a state of being surrounded by the rods 4*a* of the support frame 4, and thus the air blower 2 is positionally restricted and is connected with the table 5. This prevents accidental movement.

Subsequently, the shaft 3*a* of the air guide umbrella 3 is inserted into the support rod portion 4*d* and the shaft 3*a* of the air guide umbrella 3 is fixed using a fixing means formed of a structure including the fixing bolt 6*a* and the fixing nut 6*b* or other structures, which results in a state where the air blowing device 1 is mounted on the table 5 as illustrated in FIG. 1.

Additionally, the rising-air generating air-blowing machine 7 having the discharge opening 2*a* directed upward is assembled from the air blower 2 and the table 5.

When the air blower 2 is operated to blow air through the discharge opening 2*a*, rising air indicated by an arrow P in FIG. 1 is generated along the shaft 3*a* of the air guide umbrella 3. When the rising air P reaches the air guide umbrella 3, the rising air is guided by the inner surface of the umbrella unit 3*b* and the direction thereof is changed. When air is guided by the inner surface of the umbrella unit 3*b*, the direction thereof is changed to a direction indicated by an arrow R in FIG. 1 because the inner surface of the umbrella unit 3*b* is formed of a curved surface or a part of a sloping surface. Then, after the air gets out of guide of the umbrella unit 3*b*, descending air indicated by an arrow Q in FIG. 1 is generated. The descending air Q is blown from all portions of an outer edge of the circular umbrella unit 3*b*, and thus air is blown over a 360-degree range along a circumference centered at the air blower 2. Thus, air is blown to users present around the table 5 from above. In addition, the descending air Q surely reaches users because there is no obstruction that blocks air blown from above. Therefore, users who do work, eat and drink, have conversation, or do other things at the table 5 can receive a wind to keep out the heat in summer, thereby enhancing comfort during working or eating/drinking.

Further, when the descending air Q reaches a lower portion of the table 5, the descending air Q is again taken in through the suction opening of the air blower 2 and is discharged from the discharge opening 2*a* to generate the rising air P. Thus, a part of air circulates between the air blower 2 and the air guide umbrella 3, which reduces an amount of heated air supplied from outside. This lessens discomfort caused by the heat in the descending air Q blown to users.

By allowing a user of the table 5 to turn on and off the air blower 2 by the user's operation, it is possible to prevent the air blower 2 from operating in the absence of a user. Alternatively, the air blower 2 can be turned on and off using a motion sensor.

Moreover, by forming the air blower 2 such that it can blow warm air, it is possible to supply the descending air Q as warm air. Then, also in winter, using the air blowing device 1 can improve comfort during outdoor working, eating/drinking, and the like.

Next, the air blowing device and the air blowing machine for generating rising air according to the present invention will be described based on a second embodiment illustrated in FIGS. 4 to 6. Note that the same parts as the parts described in the first embodiment are denoted by the same reference signs.

In the second embodiment, an air filter 21 is attached to a suction opening of an air blower 2. The air filter 21, which preferably meets specifications that enable capture of PM 2.5, allows air from which particulate matters are removed by the air filter 21 to be blown from the discharge opening 2*a*.

Figure 6:
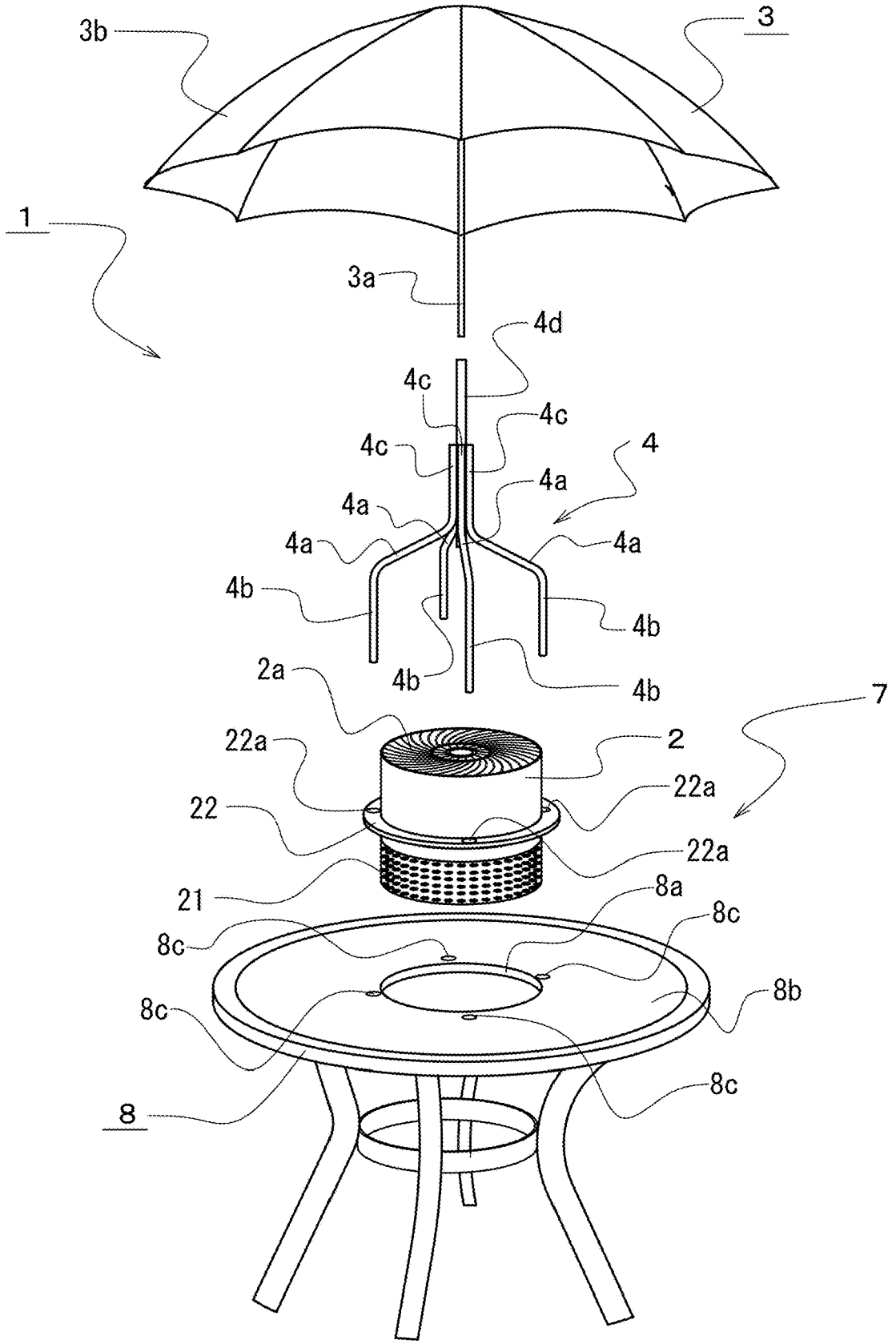
FIG. 6 is a schematic exploded perspective view for explaining the air blowing device and the air blowing machine for generating rising air illustrated in FIG. 4.

In a table 8 forming a rising-air generating air-blowing machine 7, an opening 8*a* through which the air blower 2 can be inserted is formed as illustrated in FIG. 6. A discharge opening 2*a* of the air blower 2 is directed upward with the air blower 2 inserted through the opening 8*a*. As illustrated in FIG. 6, four insertion holes 8*c* are formed at regular intervals around periphery of the opening 8*a*. A flange 22 is provided in a center of a body of the air blower 2. When the body of the air blower 2 is inserted through the opening 8*a*, the flange 22 comes into contact with an upper periphery of the opening 8*a* and a lower portion of the air blower 2 is positioned below a top plate 8*b* of the table 8. Further, as illustrated in FIG. 6, mounting holes 22*a* of the flange 22 are formed in positions aligned with the insertion holes 8*c*.

Respective legs 4*b* of four rods 4*a* of a support frame 4 are located in a state of surrounding the periphery of the air blower 2 inserted through the opening 8*a*. As illustrated in FIGS. 4 and 5, lower ends of the legs 4*b* of the support frame 4 pass through the mounting holes 22*a* of the flange 22 and the insertion holes 8*c* of the top plate 8*b* of table 8. Male screws are formed in the tip ends of the legs 4*b* and nuts formed of female threads screwed to the male screws can be used as fixing members 4*e*. Additionally, there can be adopted a configuration in which fixing is achieved using a combination of a bolt or the like separate from the leg 4*b*, and the fixing member 4*e* such as a nut.

Operations of the air blowing device 1 according to the second embodiment illustrated in FIGS. 4 to 6 will be described below.

Figure 5:
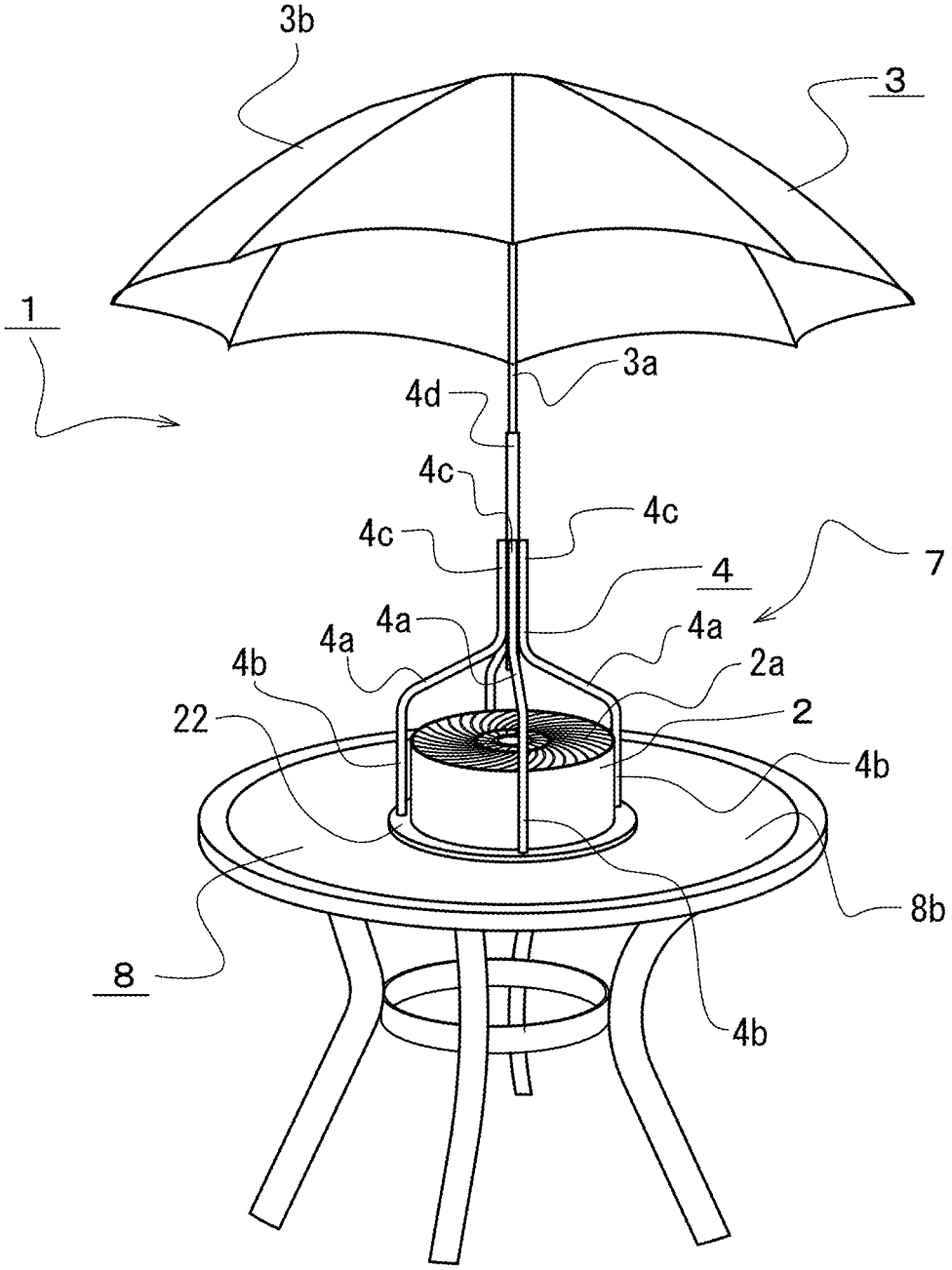
FIG. 5 is a schematic perspective view for explaining the air blowing device and the air blowing machine for generating rising air illustrated in FIG. 4.

As illustrated in FIG. 5, when the air blower 2 is inserted through the opening 8*a* formed in the top plate 8*b* of the table 8, the flange 22 comes into contact with the periphery of the opening 8*a* on the upper surface of the top plate 8*b* and the air blower 2 is held. At that time, the mounting holes 22*a* formed in the flange 22 and the insertion holes 8*c* formed around the periphery of the opening 8*a* in the top plate 8*b* are aligned with each other, and the tip ends of the four legs 4*b* of the support frame 4 are inserted through the mounting holes 22*a* and the insertion holes 8*c*. The tip ends of the legs 4*b* protruding downward from the top plate 8*b* are connected with the fixing members 4*e*, thereby fixing the four legs 4*b*. In a case where male screws are formed in the tip ends of the legs 4*b*, the fixing members 4*e* of nuts are screwed to the male screws and fastened, thereby achieving fixing simply and easily.

As a result of this, the air blower 2 is fixed to and connected with the table 8 via the flange 22, thereby preventing accidental movement. Then, a rising-air generating air-blowing machine 7 having the discharge opening 2*a* directed upward is assembled from the air blower 2 and the table 8.

Next, a shaft 3*a* of an air guide umbrella 3 is inserted into a support rod portion 4*d* and the shaft 3*a* is fixed using a fixing means formed of a structure including a fixing bolt 6*a* and a fixing nut 6*b* or other structures, so that the air blowing device 1 is assembled as illustrated in FIGS. 4 and 5.

When the air blower 2 is operated to blow air through the discharge opening 2*a*, rising air indicated by an arrow P in FIG. 4 is generated along the shaft 3*a* of the air guide umbrella 3.

An air filter 21 is attached to the suction opening of the air blower 2 and captures dust or the like from air to be taken in by the air blower 2. Thus, dust or the like is removed from the rising air P and clean air is blown. In a case where the air filter 21 is capable of capturing PM 2.5, the rising air P contains no particulate matters and cleaner air is discharged.

When the rising air P reaches the air guide umbrella 3, the air is guided by the inner surface of an umbrella unit 3*b* and the direction thereof is changed to a direction indicated by an arrow R in FIG. 4. Subsequently, descending air Q is generated and air is blown to users present around the table 8 from above without being hindered.

In particular, dust or the like is removed from air being blown to a user by the air filter 21 attached to the air blower 2, which reduces damages caused by dust or the like in a case where the user is eating and drinking, for example.

Further, as described above, when the descending air Q reaches a lower portion of the table 8, the air is again taken in through the suction opening of the air blower 2 and removal of dust by the air filter 21, together with circulation of air, is efficiently achieved.

Figure 7:
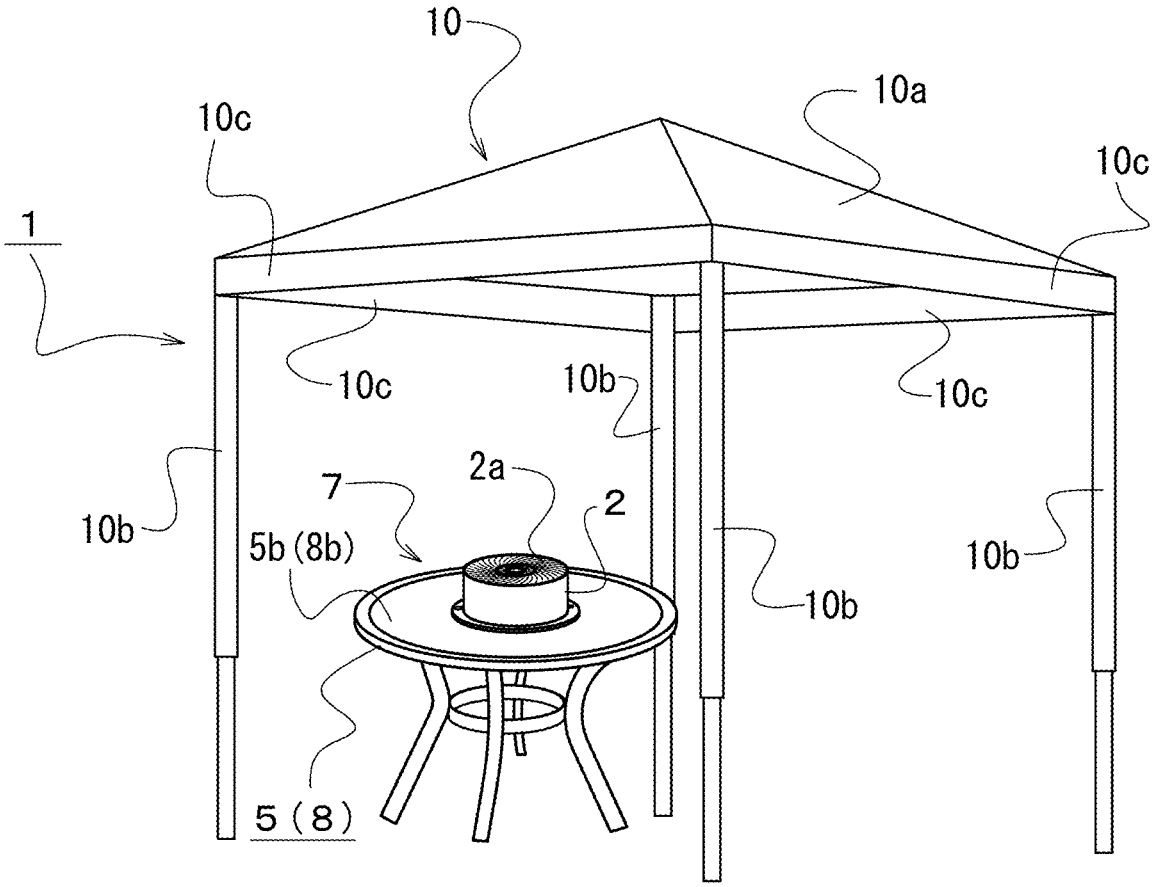
FIG. 7 is a schematic perspective view for explaining a third embodiment of the air blowing device and the air blowing machine for generating rising air according to the present invention.

FIG. 7 illustrates a third preferred embodiment of the air blowing device 1 according to the present invention.

It is also preferable to form the air blowing device 1 using a combination of a self-standing tent 10 such as a sunshade tent supported by struts and a rising-air generating air-blowing machine 7 in the same manner as in the third embodiment. FIG. 7 outlines the air blowing device 1 including that kind of tent 10. A roof 10*a* including a sheet formed to have a shape of a rectangular pyramid is supported by struts 10*b* and is used as a sunshade or the like that blocks direct sunlight.

The rising-air generating air-blowing machine 7 including a support stand such as a table 5 (or 8) and an air blower 2 is placed below the roof 10*a* of the tent 10. In this case, the roof 10*a* functions as a wind-direction changing device. The direction of rising air blown from the air blower 2 is changed to a direction along the inner surface of the roof 10*a* and air flows along the inner surface of the roof 10*a*. The direction is changed to a downward direction along a skirt portion 10*c* in a lower end of the roof 10*a*, which generates descending air. This descending air is blown to people present in the tent 10 and enhances their comfort.

For the tent 10 of this kind, which has an area of a length of approximately 2500 mm by a width of 2500 mm, installing one rising-air generating air-blowing machine 7 can provide comfort to users. Additionally, the specifications and the number of the rising-air generating air-blowing machines 7 to be installed can be set depending on the kind of work to be done in a tent or on the size of the tent 10.

Further, in a case where the rising-air generating air-blowing machine 7 is used in the tent 10, the table 5 (or 8) can be replaced by a stand or the like having an appropriate height in accordance with the situation or environment in which the tent 10 is used, the height of the roof, or the like. Alternatively, the table 5 (or 8) can also be used by placing the table 5 (8) on a stand having an appropriate height.

Further, the rising-air generating air-blowing machine 7 can be placed below a so-called tarpaulin tent in which poles are supported in a state of standing erect by a supporting means formed of a combination of at least two pieces of rope and pegs and a sheet for sunshade is stretched across the upper ends of the poles. In this case, the sheet functions as a wind-direction changing device. Rising air from the air blower 2 collides against the sheet to change the direction thereof, and air flows along a lower surface of the sheet and then is blown to a person present near a lower end of the sheet, thereby making the person comfortable.

Furthermore, the discharge opening 2*a* of the air blower 2 is divided into the arbitrary number of sections, and each of the sections is provided with a shield plate, to block air blow from an arbitrary portion. Closing a part of the discharge opening with the shield plate can prevent air from being blown to a user who does not like to face a wind. Moreover, it is preferable that the opening degree of the discharge opening can be adjusted using the shield plate.

Further, by attaching a mist generation device to the wind-direction changing device, it is possible to mix mist into air blown from the air blower 2. Additionally, in a case where mist is mixed, it is preferable to mix mist in air at the time when the direction of rising air is being changed or in descending air.

Further, though it has been described above that an air filter is attached to the suction opening of the air blower 2, the air filter may be attached to the discharge opening 2*a*. The configuration in which the air filter is attached to the suction opening is preferable because it can prevent dust from entering into the air blower 2.

Further, there has been described above a configuration in which the air blower 2 is held by the circular table 5 and the air guide umbrella 3 including the umbrella unit 3*b* that has a shape of a circular or polygonal umbrella in plan view is used as the wind-direction changing device. However, their shapes are not limited to those described above. For example, there can be provided a configuration formed of a combination of an air blower including a discharge opening having a shape of a long narrow band and a wind-direction changing device including eaves having a shape of a sloping roof. In this case, the lower tip ends of the eaves are curved so as to be directed downward and the rising air is caused to collide against upper portions of the eaves, the direction is changed along the slope of the eaves and descending air can be generated by the curved portions in the lower ends of the eaves. Further, in this case, a rectangular table having sides substantially equal in length to the discharge opening can be used as the support stand.

Moreover, descending air can be generated also when the air blower 2 is mounted on a central portion of a rectangular table, and further, the rectangular table can be combined with an air guide umbrella including an umbrella unit that has a rectangular shape in plan view.

Furthermore, though the above description has dealt with a case where the air blowing device 1 is installed outdoors, the air blowing device 1 can be installed indoors, of course.

The air blowing device according to the present invention blows air to an area around an installed table or the like from above, so that people can avoid the heat in doing various kinds of work or enjoying eating/drinking or conversation outdoors in summer. Further, warm air is blown from above in winter, and thus a comfortable space can be provided in both summer and winter. Comfortable eating/drinking space can be provided in an outdoor area of a convenience store, a coffee shop and the like, for example, so as to contribute to customer attraction to those stores.

The invention claimed is:

1. An air blowing device comprising:

an air blower provided in connection with a support stand, the air blower being configured to blow air from a discharge opening to generate rising air, the air blower including a body, and a flange protruding outwardly from the body and being supported by the support stand;

a support frame attached to the support stand; and a wind-direction changing device configured to change a wind direction to a direction crossing a direction of the rising air upon receipt of the rising air, wherein the wind-direction changing device is configured to generate descending air in a direction in which the descending air is blown to an area around the air blower, the wind-direction changing device is supported by the support frame, the wind-direction changing device includes an umbrella unit that is formed to have a shape of a circular or polygonal umbrella in plan view, and the air blown from the air blower is caused to rise along a center line of the umbrella unit and collide against an inner surface of the umbrella unit.

2. The air blowing device according to claim 1, wherein the support stand is a table usable for eating and drinking.

3. The air blowing device according to claim 1, wherein the air blower is capable of blowing warm air.

4. An air blowing device comprising:

an air blower provided in connection with a support stand, the air blower being configured to blow air from a discharge opening to generate rising air, the air blower including a body, and a flange protruding outwardly from the body and being supported by the support stand;

a support frame attached to the support stand; and a wind-direction changing device configured to change a wind direction to a direction crossing a direction of the rising air upon receipt of the rising air, wherein the wind-direction changing device is configured to generate descending air in a direction in which the descending air is blown to an area around the air blower, the wind-direction changing device is supported by the support frame, and a plurality of shield plates are provided on the discharge opening of the air blower to allow a part of the discharge opening to be opened and closed by the plurality of shield plates so that air blow in a desired direction is blocked.

5. An air blowing machine, comprising:

a support stand; and an air blowing device including an air blower provided in connection with the support stand and being configured to blow air from a discharge opening to generate rising air, the air blower including a body, and a flange protruding outwardly from the body and being supported by the support stand, a support frame attached to the support stand, and a wind-direction changing device configured to change a wind direction to a direction crossing a direction of the rising air upon receipt of the rising air, wherein the wind-direction changing device is configured to generate descending air in a direction in which the descending air is blown to an area around the air blower, the wind-direction changing device is supported by the support frame, and the air blowing device is supported by the support stand while the discharge opening is directed upward, the support frame includes a support rod portion configured to receive a shaft of the wind-direction changing device, and a plurality of legs connected to the support rod portion and surrounding a periphery of the air blower, and the flange includes a plurality of mounting holes to receive the plurality of legs respectively.

6. The air blowing machine according to claim 5, wherein the air blowing machine for generating rising air is capable of blowing warm air.

7. The air blowing machine according to claim 5, wherein the support stand is a table usable for eating and drinking.

8. An air blowing device comprising:

an air blower provided in connection with a support stand, the air blower being configured to blow air from a discharge opening to generate rising air, the air blower including a body, and a flange protruding outwardly from the body and being supported by the support stand;

a support frame attached to the support stand; and a wind-direction changing device configured to change a wind direction to a direction crossing a direction of the rising air upon receipt of the rising air, wherein the wind-direction changing device is configured to generate descending air in a direction in which the descending air is blown to an area around the air blower, the wind-direction changing device is supported by the support frame, the support frame includes a support rod portion configured to receive a shaft of the wind-direction changing device, and a plurality of legs connected to the support rod portion and surrounding a periphery of the air blower, and the flange includes a plurality of mounting holes to receive the plurality of legs respectively.

* * * * *